United States Patent [19]

Van Wilson et al.

[11] 4,313,578

[45] Feb. 2, 1982

[54] YARN TENSION CONTROL APPARATUS

[75] Inventors: Marlin Van Wilson, Barboursville, Va.; Lawrence C. Nickell, Fairlea; Larry C. Nickell, Lewisburg, both of W. Va.

[73] Assignee: Appalachian Electronic Instruments, Inc., Ronceverte, W. Va.

[21] Appl. No.: 31,477

[22] Filed: Apr. 19, 1979

Related U.S. Application Data

[63] Continuation-in-part of Ser. No. 928,572, Jul. 27, 1978, abandoned.

[51] Int. Cl.[3] ..... B65H 59/22

[52] U.S. Cl. ..... 242/149; 242/150 M

[58] Field of Search ..... 242/149, 150 M, 150 R, 242/155 M, 147 R, 131, 131.1

[56] References Cited

U.S. PATENT DOCUMENTS

| | | | |
|---|---|---|---|
| 2,281,204 | 4/1942 | Raymond | 242/149 X |
| 2,907,535 | 10/1959 | Mindheim et al. | 242/150 M |
| 3,100,091 | 8/1963 | Mindheim et al. | 242/150 M |
| 3,459,389 | 8/1969 | Wildi et al. | 242/150 R |
| 3,606,196 | 9/1971 | Heard | 242/155 M |
| 3,991,954 | 11/1976 | Schwartz | 242/150 M |
| 4,123,014 | 10/1978 | McCullough | 242/152.1 |
| 4,202,511 | 5/1980 | Koslowski | 242/150 R |

FOREIGN PATENT DOCUMENTS

| | | | |
|---|---|---|---|
| 2031006 | 3/1971 | Fed. Rep. of Germany | 242/150 M |
| 400029 | 4/1966 | Switzerland | 242/150 M |

*Primary Examiner*—Stanley N. Gilreath

*Attorney, Agent, or Firm*—Mason, Fenwick & Lawrence

[57] ABSTRACT

A yarn tension control apparatus for tensioning a running length of yarn such as textile yarns or the like, wherein a plurality of tensioning devices form a controlled channel and are controlled by an electronic control circuit having a manually adjustable tension setting potentiometer for adjusting a circuit to provide output voltages to the tension devices of the channel adding selecting tension values to the yarn. The tensioning devices each comprise an electromagnet coil and core structure alongside which a pair of wear surface members in the form of plates or discs are supported in parallel vertical planes with the yarn running between and engaging the confronting surfaces of the wear surface members and the wear surface member located beyond the yarn plane from the coil and core structure being of magnetic material to be drawn toward the companion wear member by magnetic attractive forces to vary the tensioning of the yarn leaving the yarn tension devices. In the disc wear member embodiment, one of the discs is driven by a motor to effect a wiping action on the yarn. Degaussing circuit means are also disclosed for applying intermittent negative going pulses descending to a negative voltage level to the electromagnet coils during downward adjustment of the tension setting potentiometer to minimize residual magnetic effects.

51 Claims, 13 Drawing Figures

Fig-4
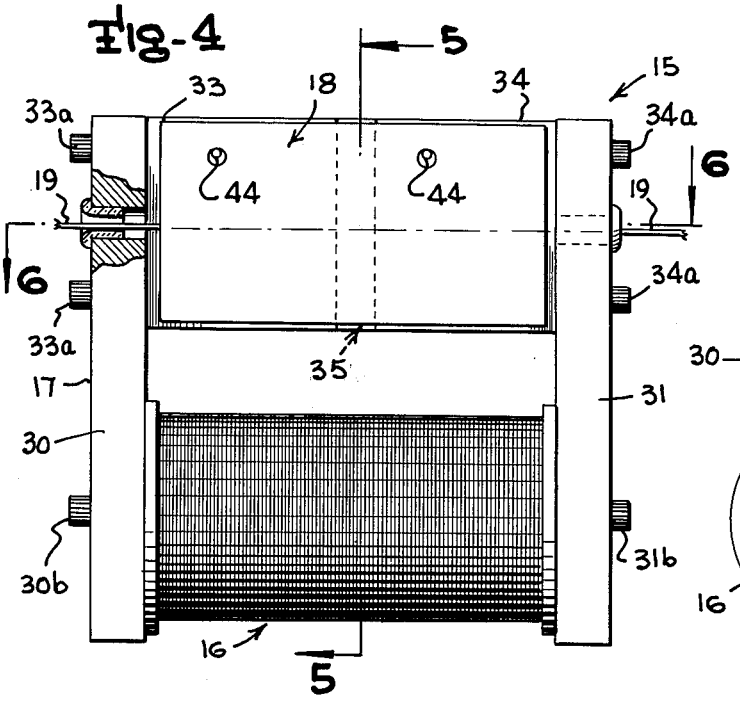
Fig-5
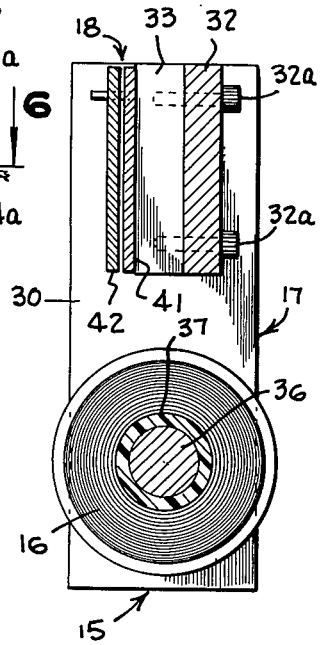
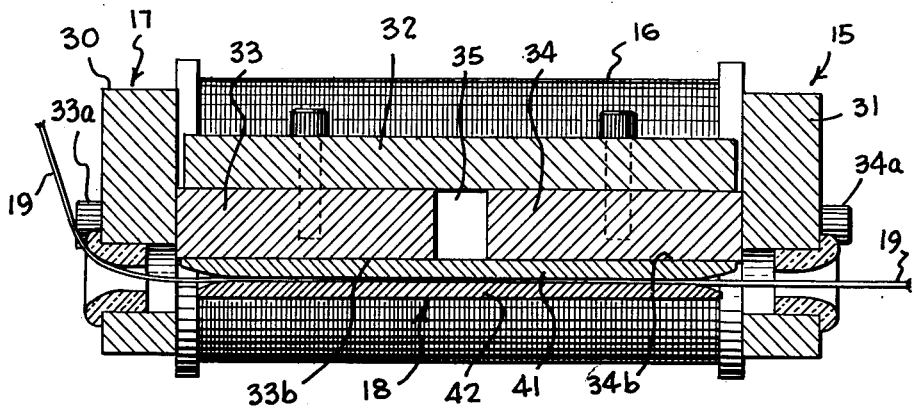
Fig-6

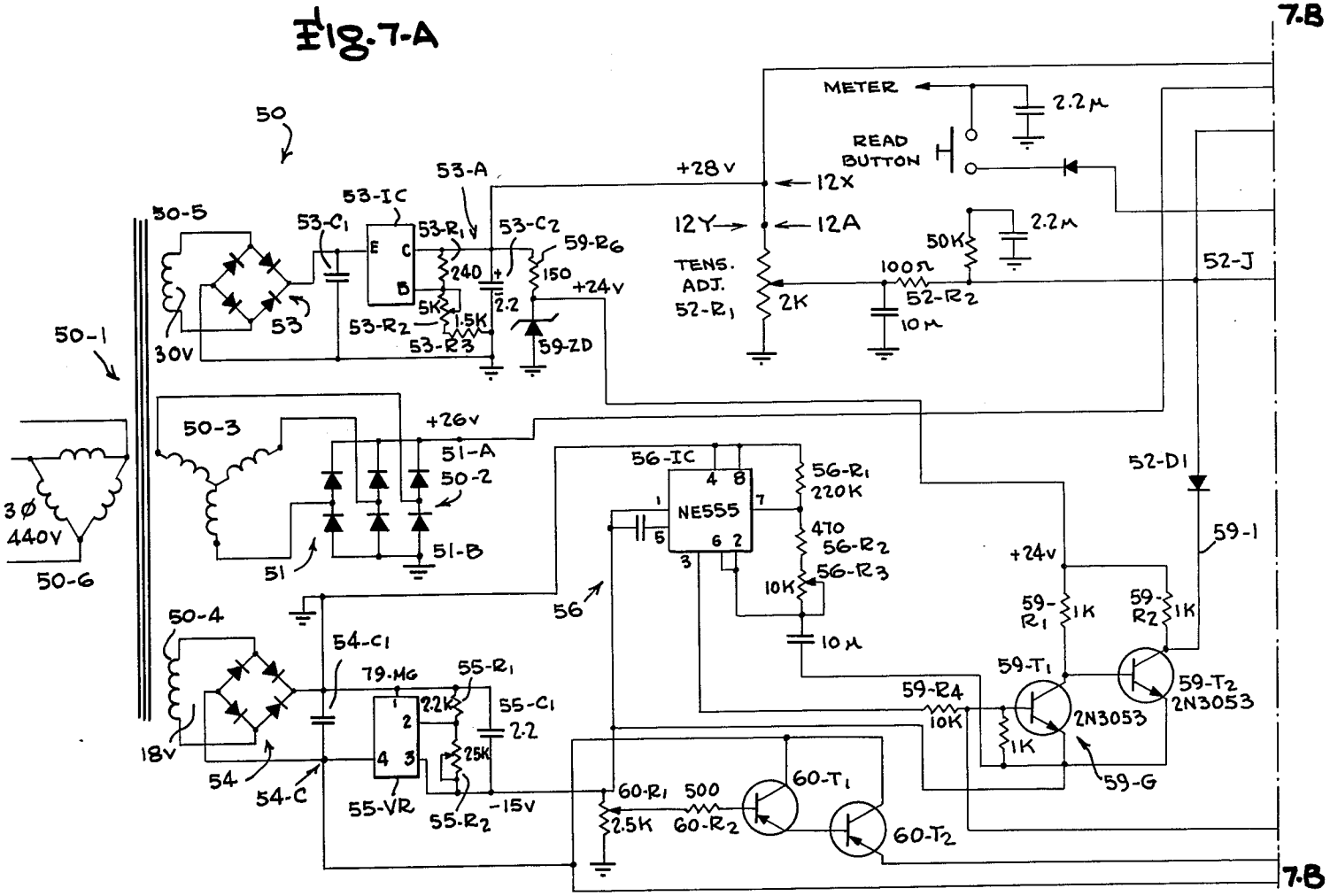
FIG. 7-A

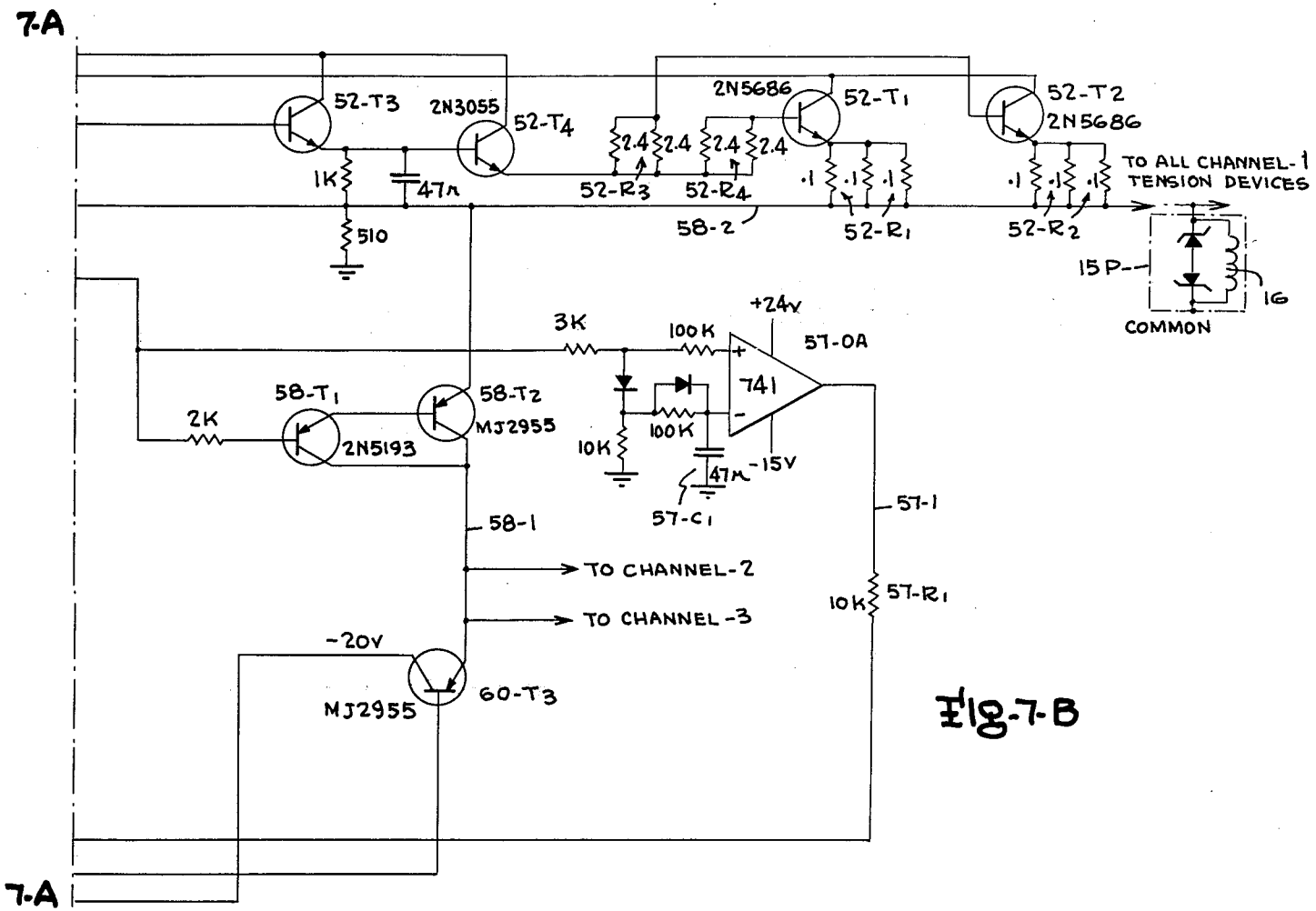
FIG-7-B

Fig-8
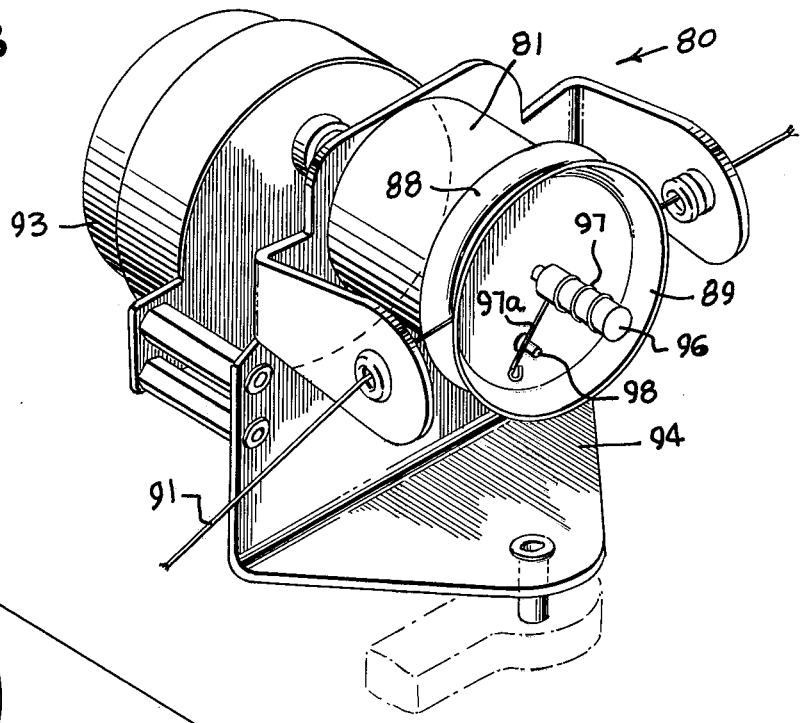
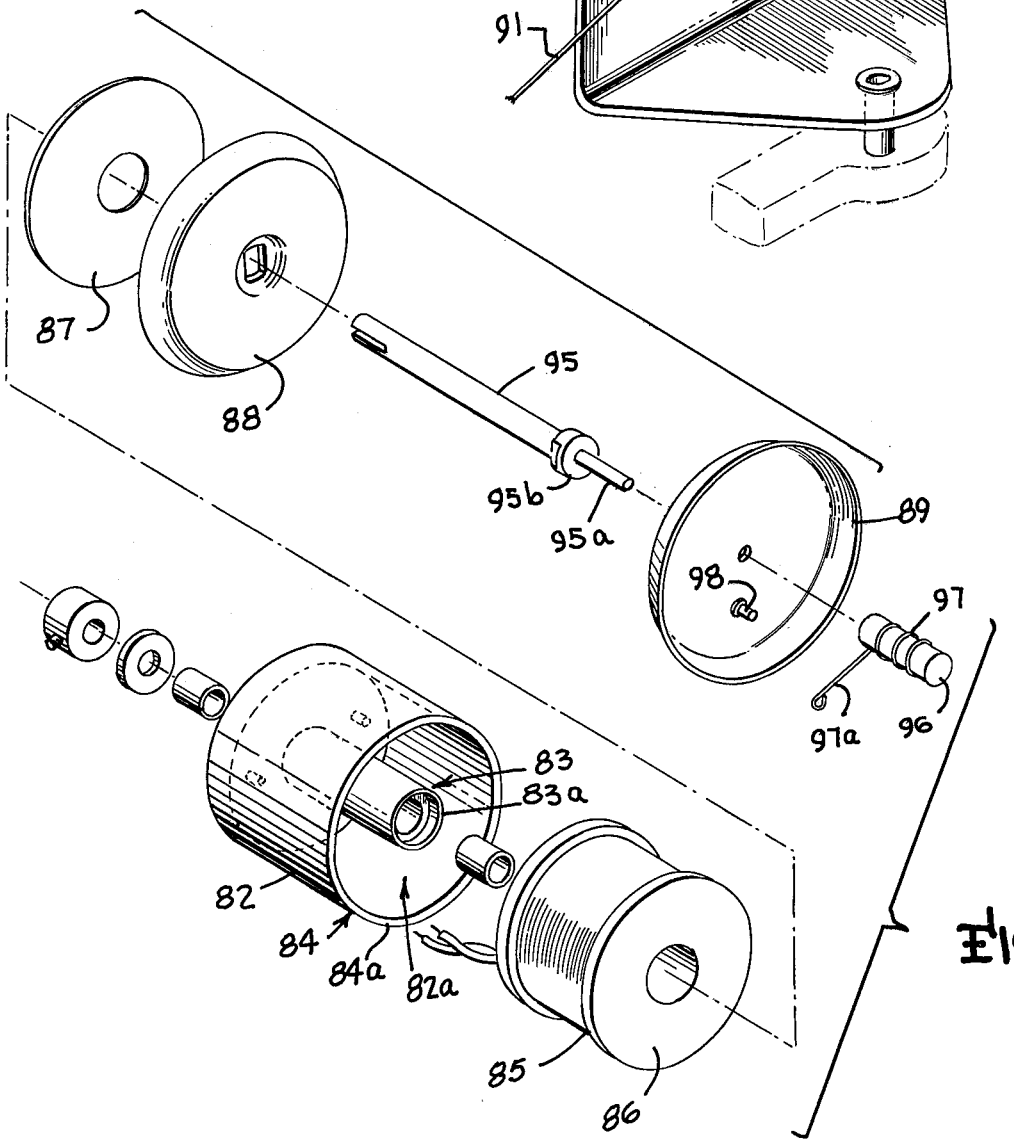
Fig-9

YARN TENSION CONTROL APPARATUS

BACKGROUND AND OBJECTS OF THE INVENTION

This application is a continuation in part of our earlier application Ser. No. 928,572 filed July 27, 1978, now abandoned.

The present invention relates in general to yarn tensioning apparatus for tensioning a running length of yarn, such as textile yarn or industrial yarn, or the like, and more particularly to yarn tension control apparatus having a pair of adjacent confronting yarn wear surface members and electromagnet means for tension control of textile yarn which is electronically controlled to exert electromagnetic tensioning forces on the yarn from a control capable of governing large groups of the units to tension the leaving yarn at substantially a selected tension value.

There is a widespread dependence of overall quality in most textile processing on the precision or uniformity of tension of the individual yarn ends. Once yarn tension control is lost or allowed to vary at any point of the process, whether winding, beaming, texturizing, knitting or other fabric formations, the quality degeneration is difficult or impossible to compensate for. Streaking, barre, off yield, excessive knitting defects, denier variation, are familiar problems that frequently have their origin in incorrect or uncontrolled tension of the individual yarn ends.

Probably the most common type of tension device in current use is the post and disc type tensioner wherein the yarn is routed around circular posts to generate friction and build tension. The advantage of this type tensioner is its simplicity and low cost, but it has a significant disadvantage in that the tension developed by the wrapping depends on how much tension is in the yarn as it approaches the wrapped post. Since the tension in the yarn leaving such a tensioner is equal to the tension from the yarn source times a constant K determined by the wrap angle or number of posts, and the tension of the yarn going into the post and disc unit is usually uncontrolled, multiplying the supply or feed yarn tension by some factor simply makes the tension larger but still uncontrolled. For example, considering a common example involving pulling yarn from packages for warping, the supply or feed yarn tension to the post and disc tensioners may vary from ½ gram for a full package fed at 100 yards/min. as the beamer is coming up to speed after a stop to remove a slub, to 1 gram for the full package at full beamer running speed of 500 yards/min. to 3 grams when the package is almost empty at full beamer running speed. If these variations are applied to a post and disc type tensioner which multiplies tension by some value, such as 5, then the yarn tension to the beamer would vary between 2½ and 15 grams, producing a 6 to 1 variation in tension which can cause streaks in finishing, defects in knitting, etc.

An object of the present invention, therefore, is the provision of a novel yarn tensioner apparatus of the controlled additive type which can be electronically commanded to add a certain tension value to the yarn being fed therethrough and thereby minimize the effects of uncontrolled input tension.

Another object of the present invention is the provision of a novel yarn tension apparatus having an electromagnet coil for applying tension adding magnetic forces to yarn wear surface members having confronting yarn wear planar surfaces located in parallel vertical planes and in the magnetic force field of the coil controlled by electronic circuitry which enable the tension value added to the yarn to be readily adjusted to different desired values and which provides highly accurate tension control over a wide range of textile yarn tensions.

Another object of the present invention is the provision of a novel yarn tension apparatus of the type described in the immediately preceding paragraph, wherein the electronic circuitry includes a manually operable tension setting potentiometer for adjusting the voltage level of control signals being supplied to the tensioning device to determine the amount of tension to be added and includes degaussing circuitry for supplying negative pulses to the coil which periodically descend to a negative voltage level during periods of adjustment of the potentiometer to reduce the voltage level of the tension control signals and thereby minimize residual magnetism effects.

Yet another object of the present invention is the provision of a novel yarn tensioning apparatus having yarn wear surface members and electronic circuit control as described in the three immediately preceding paragraphs, and means responsive to variations in yarn feeding speed of yarns fed therethrough to automatically vary the control signals in predetermined relation to the yarn speed variations.

Other objects, advantages and capabilities of the present invention will become apparent from the following detail description, taken in conjunction with the accompanying drawings showing preferred embodiments of the invention.

BRIEF DESCRIPTION OF THE FIGURES

FIG. 4 is a front elevation view of the tension control device of FIG. 2;

FIG. 5 is a longitudinal section view thereof, taken along line 5—5 of FIG. 4;

FIG. 6 is a section view, taken along the line 6—6 of FIG. 5;

FIG. 7A & 7B form a schematic diagram of an electronic control system for manual adjustment control of a large number of the yarn tension control devices in a multichannel control system;

FIGS. 8 is a perspective view of a disc type electromagnetic tensioning device embodying the present invention;

FIG. 9 is a fragmentary exploded perspective view of the electromagnet and disc assembly of the FIG. 8 embodiment;

DETAILED DESCRIPTION OF A PREFERRED EMBODIMENT

Figure 1:
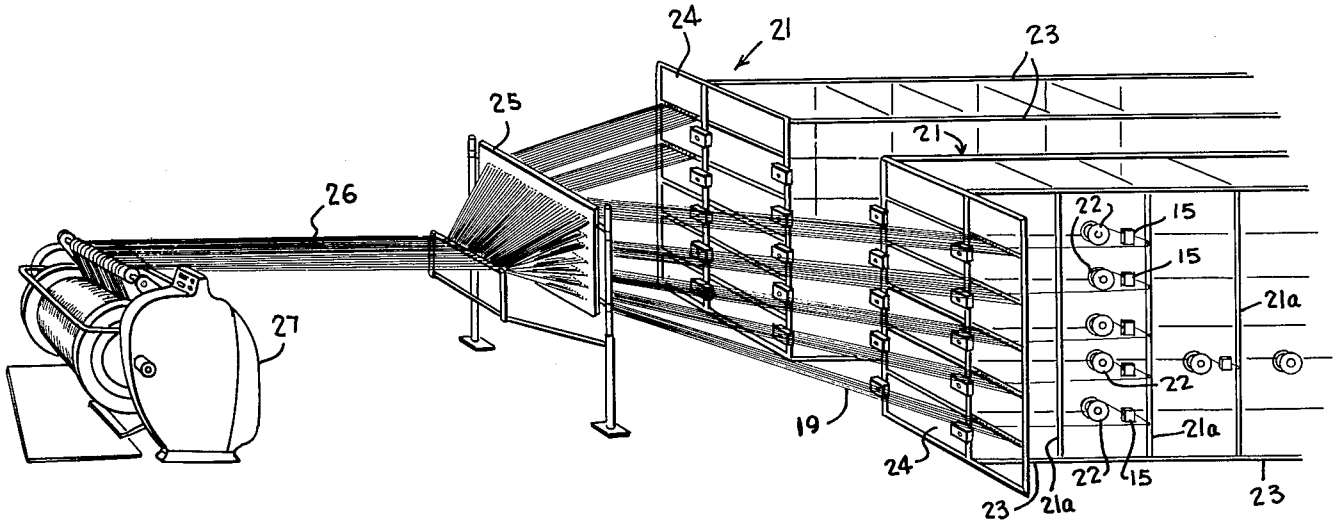
FIG. 1 is a somewhat diagrammatic perspective view of a typical creel and warper installation having yarn tension control devices of the present invention for regulating yarn tension to the warper.
Figure 2:
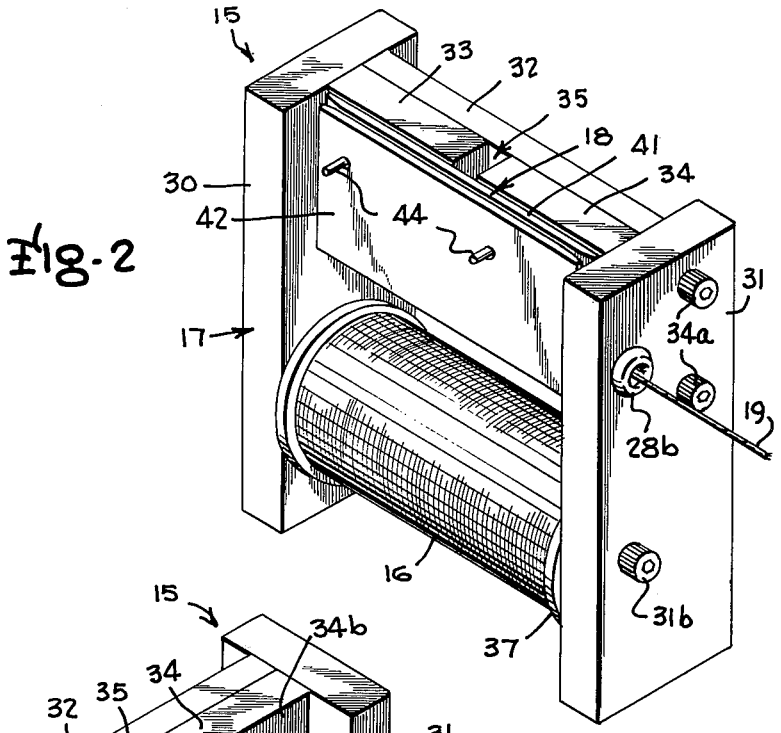
FIG. 2 is a perspective view of a form of yarn tension control device of the present invention having rectangular wear plates.
Figure 3:
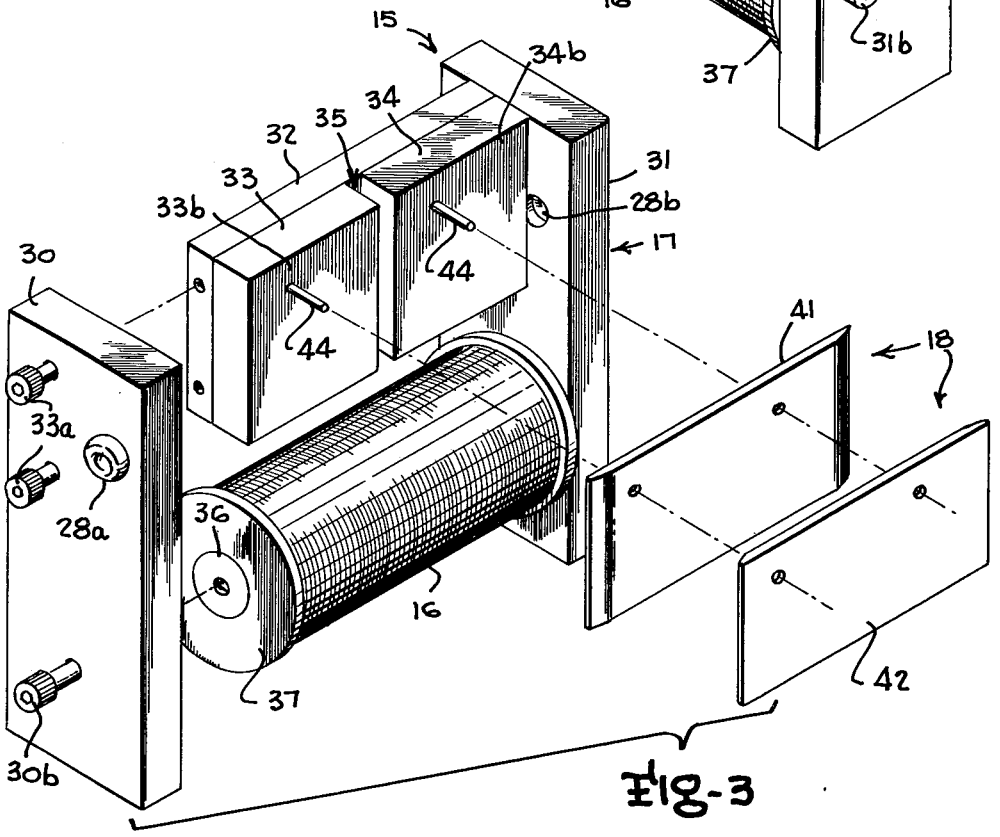
FIG. 3 is a perspective view similar to FIG. 2 with the wear plates exploded away from the pole pieces.
Figure 10:
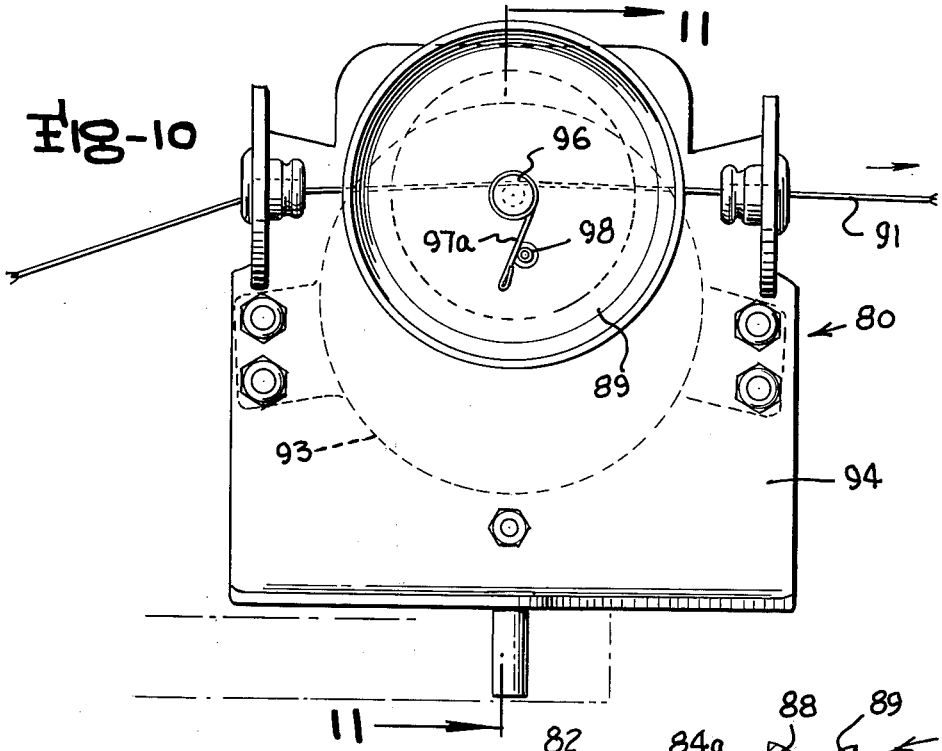
FIG. 10 is a front elevation view of the FIG. 8 form.
Figure 11:
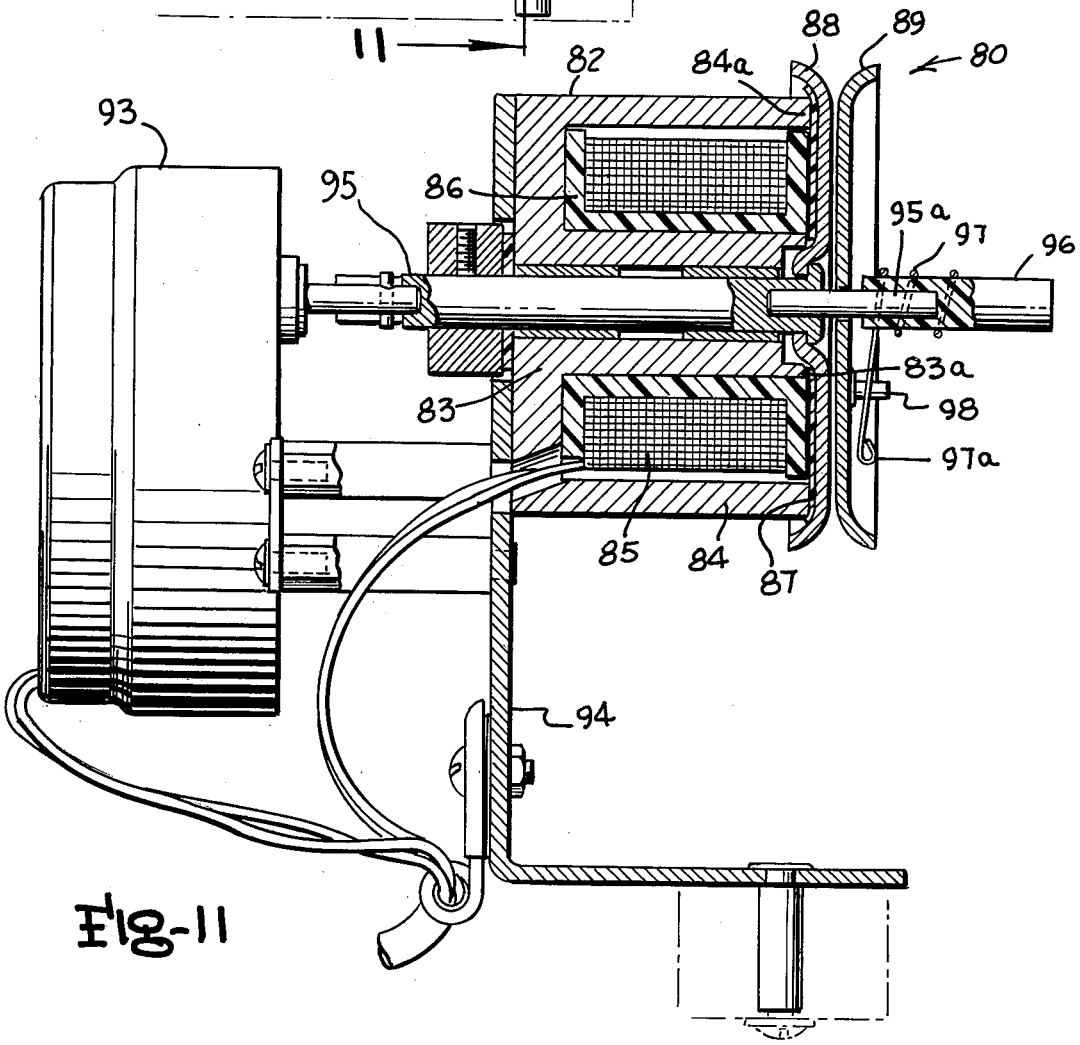
FIG. 11 is a vertical section view, taken along the line 11—11 of FIG. 10; and, FIG. 12 is a schematic diagram of additional portions of an electronic control system to be added to the circuitry of FIGS. 7A and 7B to provide automatic variation in magnetic tension-producing force with varying yarn speed.

Referring to the drawings, wherein like reference characters designate corresponding parts throughout the several figures, and particularly to FIGS. 1 to 5, a preferred form of the yarn tension control device of the present invention is indicated by the reference character 15 and comprises an electromagnet coil 16 and an associated core assembly 17 arranged generally to form a rectangular core loop having a pair of core pieces spaced apart to form a gap and having flat faces lying in a vertical plane against which are supported an assembly of parallel planiform yarn wear plates or shoes 18 arranged in parallel vertical planes between which the yarn 19 to be tensioned is passed. The electromagnet coil 16 and core assembly 17 are designed to apply controlled magnetic forces to the wear plate or shoe assembly attracting a magnetically permeable or attractive shoe or plate laterally toward an nonmagnetically attractive shoe or plate with appropriate force to add the desired tension value to the yarn 19. The device 15 may be used advantageously in beamer creel installations, circular knitting machines, texturizers, winders, or any other devices where yarn tension control is desired, but will be described in connection with a beamer creel installation. In a typical beamer installation a number of such yarn tension control units 15 equal to the number of yarns 19 being drawn from a creel assembly 21, shown fragmentarily in FIG. 1, for example 1050 yarns in a 1050 end creel, are mounted on the vertical post members 21*a* of the creel at the locations where the yarn ends leading from the yearn packages 22 exit from the creel framework 23 to be redirected through the eyelets of the separator panels 24 and eyeboard 25 and form the yarn sheet 26 being drawn onto the warper or beamer 27. Each yarn end 18 from the packages 22 is drawn through its own associated tension control unit 15 so that the tension of the respective yarn ends issuing therefrom can be set to the desired value to maintain substantially uniform tension on all the yarns being wound on the warper 27 whether the packages 22 are full or near empty and whether the warper 27 is operating at full speed or at some intermediate speed during start-up after a stop. It will be appreciated that the yarn tension control device can be used in many other applications, as to provide yarn tension control for each yarn end leading to a circular knitting machine to provide control and variation of pattern, texture, uniform tension or tension control for pattern effects and the like.

In the embodiment of the yarn tension control device 15 illustrated in FIGS. 1 to 6, the magnetic core assembly 17 is in the form of a rigid frame of generally rectangular configuration made up of a pair of parallel vertical side plates 30, 31 which are fixed at their upper end portions to a cross-wise support bar and pole piece assembly. The support bar and pole piece assembly includes the pair of spaced pole pieces 33, 34 rigidly fixed together by the support bar 32 and spaced apart to define the gap 35 therebetween, and the ends of the pole pieces opposite the gap are fixed to the vertical side plates by Allen screws 33*a*, 34*a* and are fixed to the support bar 32 by Allen screws 32*a*. Each of the pole pieces 33, 34 have planiform front faces 33*b*, 34*b*, adjacent the gap 35 and opposite the support bar 32, as shown, forming sharp right angular corners with the horizontal top and bottom surfaces and the vertical end surfaces of the pole pieces, against which the yarn wear shoes are to be mounted to lie in vertical planes paralleling the pole piece front faces 33*b*, 34*b*. The pole pieces 33, 34 are formed of steel having low magnetism retention properties in the preferred embodiment, and are secured as a rigid assembly with the support plate or bar 32, for example of nonmagnetic aluminum, by the treaded Allen screws 32*a*.

The lower end portions of the vertical side plates 30, 31 of the core are joined by Allen screws 30*b*, 31*b* to a cylindrical core piece 36 extending through a plastic spool 37, wound with "magnet" wire, such for example as about 6000 turns of #36 copper wire, to form the electromagnet coil 16, which, when supplied with electric current from the remote control circuit for the tension devices, generates appropriate magnetic flux which extends through the vertical side plates 30, 31 and pole pieces 33, 34 to the gap 35.

The wear plate or tensioning shoe assembly for variably adding tension to the yarn in relation to the magnetic flux forces is indicated generally at 18 and shown to enlarged scale in FIG. 6. The tensioning shoe assembly 18 comprises a back or rear flat rectangular shoe 41, of nonmagnetic material such as nonmagnetic stainless steel, elongated in the direction of yarn travel and having a length sufficient to span most of the distance between the vertical plates 30,31. The back or rear shoe 41 lies in a vertical plane against the front faces 33*b*,34*b* of the pole pieces 33,34 forming a back or rear wear plate or shoe for the yarn indicated at 19, across which the yarn travels between inlet and outlet eyelets 28*a*,28*b* fixed in apertures in the side plates 30,31. Immediately forwardly of the back wear plate or tensioning shoe 41 for applying frictional surface restraint on the yarn to add the desired tension forces is a front or top wear or tensioning shoe 42 of magnetic metal which is also a thin rectangular plate elongated in the direction of yarn travel. The plate or shoe 42 forms the armature bridge across the gap 35 and reacts to the magnetic flux forces produced by the coil 16 and conducted by the plates 30,31 and pole pieces 33,34 through flux paths which span the gap 35 to be drawn laterally toward the shoe 41 and apply tension adding forces to the yarns. The opposite ends of shoes 41 and 42 are flared or curved away from the yarn path along cylindrical paths as shown about axes extending vertically transverse to the yarn path, and both of the shoes 41,42 are loosely assembled on horizontal support pins 44 fixed in the pole pieces 33,34 and extending along horizontal axes through through apertures therefor in the shoes 41,42 so that the wear plate or shoes hang on the support pins 44 to lie in parallel vertical planes such that in a typical beamer creel installation, the confronting wear surfaces of the front and back wear shoes 42,41 are flush with the yarn path and parallel the faces 33*b*,34*b* of the pole pieces 33,34. In one satisfactory example, this arrangement provides about 35 grams tension for a tension control voltage of about 24 volts (at about 50 milliamps) supplied to the electromagnet coils 16.

The coil 16 and adjacent lower portions of the core may be encased with a fixed cover section (not shown) and the wear plates or shoes 41,42 and pole pieces 33,34 and upper core portions may be enclosed in a removable clip type or U-shaped cover section, or other configurations of mating housing sections or the like may be provided as desired.

FIGS. 7A and 7B illustrate collectively in schematic diagram form an electronic control system for remote manual adjustment control of a very large number of yarn tension devices of FIGS. 2–6, for example about 200 of such yarn tension devices. Referring particularly to FIGS. 7A,7B, there is shown a power supply circuit generally indicated at 50 which includes a three phase transformer 50-1 for stepping down a nominal three phase 440 volt supply to about 26 volts across the output from the rectifiers 50-2 connected to its three phase secondary windings 50-3 as shown. Additional secondary windings 50-4 and 50-5 provide 18 volts AC and 30 volts AC as indicated. The leads from the three phase secondary winding 50-3 of the transformer 50-1 are connected across the rectifier diodes 50-2 of rectifier network 51 providing +26 volts DC unregulated across the output leads 51-A,51-B. The lead 51-B is connected to electrical ground. The +26 volt DC lead 51-A provides the collector supply for the pair of driver transistors 52-T1 and 52-T2 of the tension regulator control channel for the entire group of tension devices 15, to be served by that channel which may be up to about 200 tension devices. The 30 volt AC transformer secondary winding 50-5 is connected to the diode rectifier bridge 53, whose output is connected across capacitor 53-C1 to an integrated circuit regulator 53-IC such as a LM317K and to resistors 53-R1,53-R2 and 53-R3 and capacitor 53-C2, as shown, to provide a +28 volt DC regulated supply at 53-A, for the collectors of transistors 52-T3 and 52-T4, and the upper end of the tension set potentiometer 52-R1.

The 18 volt AC secondary winding 50-4 of the transformer is also connected to a diode rectifier bridge 54 having its output coupled across capacitor 54-C1 to provide a −20 volt DC unregulated supply at terminal 54-C to supply certain transistors of a degaussing circuit as shown, and to also supply an integrated circuit voltage regulator 55-VR having resistors 55-R1 and 55-R2 and capacitor 55-C1 connected as shown to provide a −15 volt regulated DC supply to the degaussing circuit, indicated generally at 56.

As shown in FIG. 7A, the movable contact of the tension set potentiometer 52-R1 is connected through a resistor 52-R2 to a junction point 52-J, the potentiometer 52-R1 being connected between ground and the regulated +28 volt supply. The junction point 52-J is connected to the base of the tension channel control transistor 52-T3 and to a silicon diode 52-D1 to the degauss control lead 59-1. The emitter of transistor 52-T3 follows whatever voltage is set by the movable contact of 52-R1, the emitter of transistor 52-T4 tracks the voltage at the emitter of 52-T3, and the emitters of driver transistors 52-T1 and 52-T2 track the voltage at the emitter of 52-T4, to set the voltage supplied at the output 58-2 to the tension devices 15. The junction point 52-J also connects to the first transistor 58-T1 of a Darlington pair 58-T1 and 58-T2 of a 2N5193 and a MJ-2955 transistor and to the input network of an Operational Amplifier 57-OA, formed of a National Semiconductor 741 Operational Amplifier, connected to sense an initial reduction in the voltage level of the tension set potentiometer 52-R1 and apply a voltage to the gate circuit 59-G formed by transistor 59-T1 and 59-T2 and cause degaussing pulses to be applied to the degauss control line 59-1.

The degaussing circuit indicated generally at 56 is associated with the integrated circuit voltage regulator 55-VR which may be a Motorola 79MG Integrated Circuit, having pin 1 connected to electrical ground, resistor 55-R2 connected between leads from pins 2 and 3 of integrated circuit 55-VR and resistor 55-R1 connected between pin 2 and ground. The −15 volts DC regulated supply is provided from pin 3 of 55-VR to pin 1 of a pulse generator integrated circuit 56-IC, which may be a National Semiconductor 555 Integrated Circuit. Pins 4 and 8 are connected to ground, a resistor 56-R1 is connected between pins 8 and 7, and a resistor 56-R2 connected in series with potentiometer 56-R3, the latter serving as a pulse width adjustment, and connected between pin 7 and pins 6 and 2. Pin 3 is connected through resistor 59-R4 to the base of the gate transistor 59-T1 of the gate circuit 59-G whose emitter is connected to the −15 volt regulated supply and whose collector is connected through resistor 59-R1 to the 24 volt regulated supply and to the base of transistor 59-T2 whose collector is also connected through resistor 59-R2 to the +24 volt supply. The collector of the gate circuit transistor 59-T2 is connected by degauss control lead 59-1 to the silicon diode 52-D1 coupled to the junction point 52-J. The +24 volt supply for the gate transistor 59-T1 and 59-T2 and for the Operational Amplifier 57-OA is derived from the +28 volt regulated supply at 53-A by the resistor 59-R6 and Zener diode 59-ZD as shown.

With integrated circuit 59-IC wired as shown, the 10 K pulse width adjustment potentiometer 59-R3 provides width adjustment for short duration pulses at output pin 3, while the 220 K resistor 59-R1 sets the period of the square wave output produced by 59-IC. The Operational Amplifier 57-OA normally has its output high at +24 volts, holding the gate transistor 59-T1 on through the resistor 57-R1, which in turn holds gate transistor 59-T2 off, which holds line 59-1 to silicon diode 52-D1 at +24 volts, which back-biases diode 52-D1. When the Operational Amplifier 57-OA senses initial reducing voltage level on the movable contact of the tension set potentiometer 52-R1, its output goes low to −15 volts, gate transistor 59-T1 is turned off, which allows gate transistor 59-T2 to turn on and place line 59-1 at minus 15 volts, The gate transistor 59-T1 then pulses on and off, by the pulse output from pulse generator 59-IC, thus turning transistor 59-T2 off and on at the pulse rate and pulsing the line 59-1 between +24 volts and −15 volts. Potentiometer 60-R1 has a movable contact connected through resistor 60-R2 to the base of transistor 60-T1 of a transistor pair 60-T1 and 60-T2 whose collectors are connected to the −20 volt DC unregulated supply at 54-C. When line 59-1 goes to −15 volts, the Darlington pair transistor 58-T1 and 58-T2 will switch on, allowing the degauss voltage on lead 58-1 to be present on the tension voltage output line 58-2, and turns off transistor 52-T3 which turns off transistor 52-T4 and 52-T1 and 52-T2. Each time the gate transistor 59-T2 turns off during the pulse waveform, the line 59-1 returns to +24 volts, turning off the Darlington pair 58-T1 and 58-T2 and turning on transistors 52-T1, T2, T3 and T4. This action continues until capacitor 57-C1 reaches the full discharge point at which time Operational Amplifier 57-OA switches back to +24 volts and holds gate transistor 59-T1 on. The emitter of 60-T2 is connected to the base of transistor 60-T3, and its emitter is connected to the lead 58-1 to thereby establish the negative level floor or bottom to the degaussing signals. Potentiometer 60-R1 thus permits adjustment of the floor or bottom of the degaussing pulse applied to the tension control output 58-2 to whatever negative voltage level is needed to wash out any residual magnetism in the cores of the tension devices, which may be typically about −2 or −3 volts.

The normal tension control voltage for the tension device 15 is supplied to the main tension control output lead 58-2 through parallel arrays of emitter resistors, indicated generally at 52-R1 and 52-R2, formed for example of a 0.1 ohm resistor each connected to the emitters of the drive transistors 52T1 and 52-T2 the base electrodes of which are connected through resistor pair 52-R3 and 52-R4 to the emitter of the transistor 52-T4 whose collector is connected to +28 volts. The negative pulses applied from lead 58-1 to the master output lead 58-2, when the gate formed by transistors 59-T1 and 59-T2 causes the transistor 58-T2 to turn on, go to each of the tension devices 15 making up the channel through a plug for each tension device, indicated schematically at 15P in FIG. 7B, connected to the master output lead 58-2, pulsing the control voltage to the electromagnet coils to the previously mentioned negative level typically at about −2 or −3 volts, while the normal control voltage applied through the drive transistors 52-T1 and 52-T2 is concurrently removed from the master output lead 58-2 for the duration of each pulse. The plug 15P for each tension device, as illustrated, may include Zener diodes as shown to dampen inductive feedback during pulsing.

Another form of tensioning device or wear surface assembly for variably adding tension to the yarn in relation to the magnetic flux forces generated in the tensioning device in response to the current supplied to its electromagnetic coil from the master output lead of the channel control circuit is indicated generally at 80 in FIGS. 8 to 11. In the tensioning device or wear surface member assembly 80, the magnetic core assembly 81 is in the form of a rigid cup 82 of E-shaped cross-section as illustrated, providing a pair of spaced pole portions such as circular pole portion 83 and annular pole portion 84 spaced apart to define the annular gap 82*a*. The pole portions have planiform front faces 83*a*,84*a* adjacent the gap which lie in a single vertical plane, against which the yarn wear surface members are to be mounted to lie in vertical planes paralleling the pole faces 83*a*,84*a*. The cup 82 forming the pole portions is formed of steel having low magnetism retention properties in the preferred embodiment, such as sentered or powdered metal iron and forms a rigid magnet core assembly. The tensioning device 80 also includes an electromagnet coil 85, for example in the form of "magnet" wire, such as about 6000 turns of #36 copper wire, wound about a cylindrical plastic spool 86 and nested in the annular wall of the cup 82 surrounding the cylindrical core portion 83 and arranged, when supplied with electric current from the remote control circuit for the tension devices, (or an incorporated control circuit) to generate appropriate magnetic flux which extends through the pole portions 83,84 and gap 82*a*.

A pair of circular disc shaped wear surface members indicated at 88,89 forming a tensioning surface assembly 90 are supported alongside and paralleling the plane of the pole faces 83*a*,84*a*. These wear surface members include a back or rear wear surface disc 88, of nonmagnetic material such as nonmagnetic stainless steel or brass, having a diameter of about 1⅜ inch in the illustrated embodiment, so as to span most of the flat pole faces 83*a*,84*a* and arranged in a vertical plane to bear against a thin Teflon washer 87 abutting the front core faces 83*a*,84*a* to form a back or rear wear surface for the yarn, indicated at 91, traveling across the yarn path illustrated. Immediately forward of the back disc 88, or more remotely from the electromagnet core and coil, is a front wear surface disc 89 of magnetic metal of substantially the same diameter as the companion wear surface member 88 for applying frictional surface restraint to the yarn to add the desired tension forces. The wear surface disc 89 forms the armature bridge across the gap 82*a* and reacts to the magnetic flux forces produced by the coil 85 and conducted by the pole pieces through flux paths which span the gap 82*a* to be drawn laterally toward the wear surface disc 88 and apply tension adding forces to the yarns. The perimeter or edge portions of the wear surface discs 88 and 89 are flared or curved away from the yarn path along convex curves, as shown.

The tension device shown in FIGS. 8–12 provides advantages with certain types of yarn over the form shown in FIGS. 1–6, by applying a positive rotary drive to the back wear surface disc 88 from the motor 93, for example a low rpm 24 volt 60 cycle, electric motor providing a 4 rpm output for warpers, or a 0.6 rpm output for knitting machines. The motor 93 is supported by mounting posts from a bracket or frame 94 which also supports the electromagnet assembly and tension discs, and its output shaft is coupled to a disc drive shaft 95 passing through the center of the cup 82 and having a non-round front end formation 95*b* fitting in a non-round opening in the back wear disc 88 to rotate the disc 88 in an advancing direction relative to the feed direction of the yarn engaged thereby, at a slower speed than the confronting portions of the yarn moving along the yarn path. This effects a wiping action on the yarn and effects a cleaning action in the space between the two confronting wear surface discs 88,89 preventing contamination or accumulation of defects in this zone, for example from yarn finish, which might adversely effect proper operation of the tensioning devices or distort the levels of added tension applied to the yarn.

The front end of the disc driving shaft 95 terminates flush with or rearwardly of the vertical plane of the wear surface of disc 88 and a ceramic shaft extension 95*a* is friction fitted in the drive shaft 95 to project forwardly therefrom through a center hole in the front disc 89 and provide a journal support for the disc 89 immediately below the yarn path. The shaft extension 95*a* is preferably made of ceramic material to resist it being worn by engagement with the yarn passing across the shaft extension at the top of the extension, to avoid yarn wearing through the shaft as it would with brass or other material contacted by the yarn.

The front disc 89 is captured on the shaft extension 95*a* by a plastic cap 96 friction fitted on the extension 95*a*, which in the illustrated embodiment carries a spring member 97 having a coil portion surrounding and gripping the cap 96 and a finger portion 97*a* which is engaged by a stub or a projection 98 on the front disc 89. This is for the purpose of preventing the front disc 89, which tends to be driven by contact with the yarn up to a speed approaching the speed of yarn travel between the discs 88,89, from exceeding the very slow rpm speed of the driven back disc 88, since the spring finger 97*a* rotating at the speed of driven shaft 95 and back disc 88 is abutted by the projection on the disc 89 when the yarn drives it up to the shaft speed and the disc 89 can no longer exceed this speed.

Figure 12:
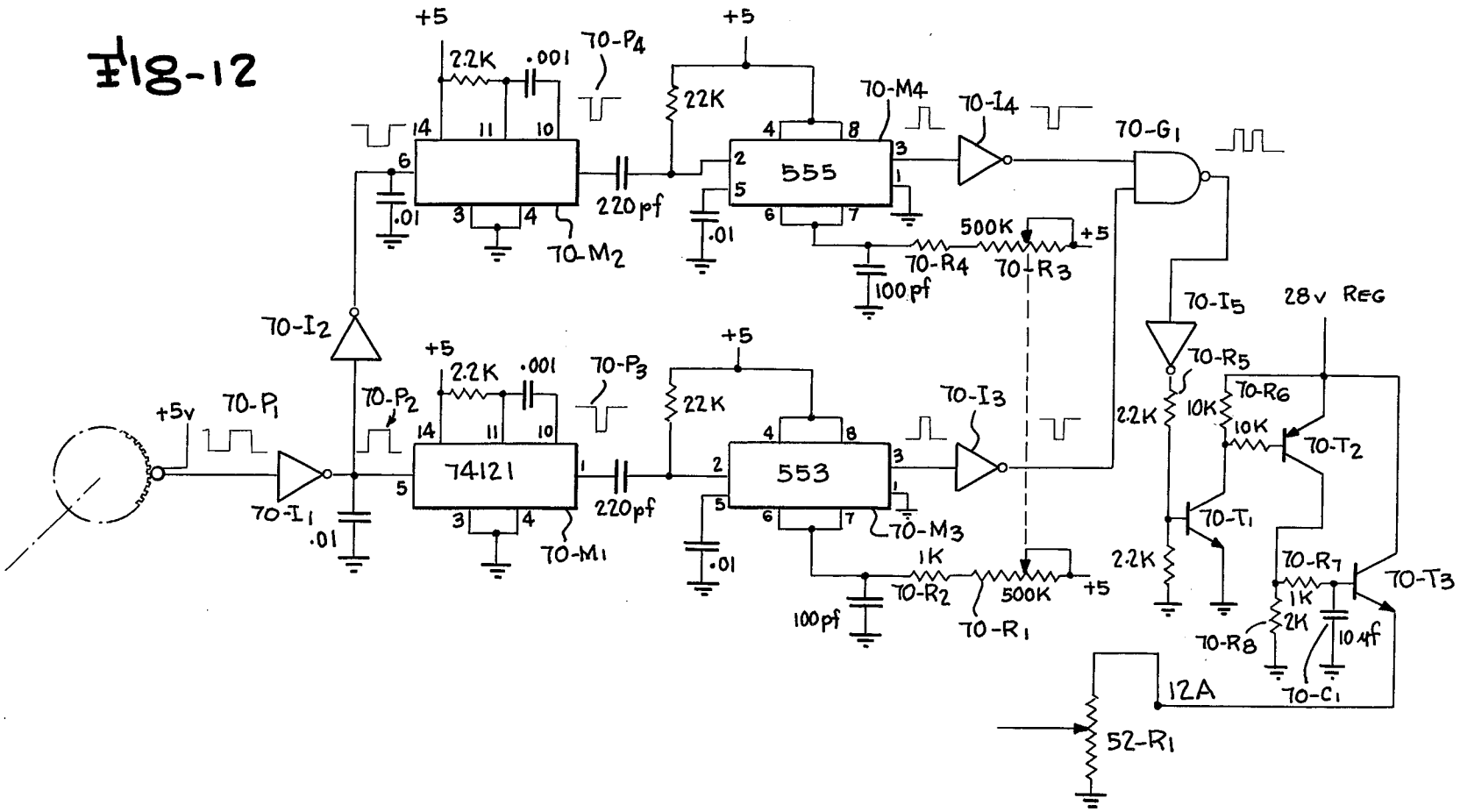

FIG. 12 illustrates in schematic diagram form further portions of an electronic control circuit to be associated with the electronic control circuit of FIGS. 7A and 7B, connected thereto, at the point designated 12A, providing a speed responsive tension equalizer or fader circuit to provide automatic variation of the yarn tension adding forces produced by the tension adjust potentiometer 52-R1 so that the control voltage to the electromagnet coils of the entire group of tension devices has a predetermined relation to variations in machine speed of the warper or beamer or knitting machine so that the tension adding properties are automatically adjusted to yarn feeding speed. When the FIG. 12 circuit is connected to point 12A of FIG. 7A, the lead from points 12x to 12y in FIG. 7A connecting the 28-volt regulated supply to the top of potentiometer 52-R1 is omitted.

As illustrated in FIG. 12, the speed responsive yarn tension equalizer indicated generally by the reference character 70 monitors timer signals from a pulse generator 70-PG which, in a warper installation, may be driven from the press roll which bears against yarn on the main warper roll and travels in relation to yarn speed. This may comprise a wheel provided with peripheral slots, for example 180 slots on a 3 inch diameter wheel, through which light from a source, such as an LED, is beamed toward a photodetector and provides a pulse pattern as indicated at 70-$P_1$ to the input of an inverter indicated at 70-I1, which may be a Texas Instrument 7404 inventer. The inverter pulse output from the inverter 70-I1 is a positive pulse, as indicated at 70-$P_2$ whose leading edge corresponds to the leading edge of the negative pulse produced for each interruption of the light beam by the wheel in the pulse generator. As one example, the pulse generator produces one negative pulse for each 0.1 inch yarn feed. The positive pulses 70-$P_2$ at the output of the inverter 70-I1 are applied to the input pin 5 of a one-shot multivibrator 70-M1 where the positive going edge of the positive pulses 70-$P_2$ trigger a negative 1.5 pulse at the output, indicated at 70-$P_3$. This negative pulse from the one-shot multivibrator 70-M1 is applied to the input pin 2 of a variable width one-shot multivibrator 70-M3 having an adjustable potentiometer indicated at 70-R1, which may be a 500K potentiometer connected through a 1K resistor 70-R2 to the pins 6 and 7 of the variable width multivibrator 70-M3 to adjust the width of the positive output pulse at the pin 3 of the multivibrator 70-M3.

The positive output pulses at the output of inverter 70-I1 are also applied to an inverter 70-I2 whose output, in the form of negative pulses, is applied to the input pin 6 of a one-shot multivibrator 70-M2 like the multivibrator 70-M1, but which is triggered by the positive going edge at the end of the negative pulse at the output of inverter 70-I1 to produce a negative pulse indicated at 70-$P_4$ which is a negative 1.5 μs pulse triggered by the positive going edge of the negative output pulses from inverter 70-I2. The pulse wave form 70-$P_1$ produced by the pulse generator is approximately a square wave pattern such that the positive going edge of the negative pulses applied to the input of the multivibrator 70-M2 occur approximately halfway between the two successive positive going edges of the pulse pattern produced by the pulse generator. Accordingly, the leading edge of the negative pulses 70-$P_4$ occur approximately halfway between the two leading edges of two successive negative pulses 70-$P_3$ at the output of the multivibrator 70-M1. Both multivibrators 70-M1 and 70-M2 may be Texas Instruments 74121 Integrated Circuits. The negative pulse pattern 70-$P_4$ from the output of multivibrator 70-M2 is applied to the input pin 2 of a variable width one-shot multivibrator 70-M4 which is like the multivibrator 70-M3 and may be formed of a National Semiconductor 555 Integrated Circuit, to produce a variable width positive pulse output responsive to setting of its associated manually adjustable potentiometer 70-R3 ganged with and like the potentiometer 70-R1 and connected through 1K resistor 70-R4 to the pins 6 and 7 of the variable width one-shot multivibrator 70-M4.

The outputs from pin 3 of the two variable width one-shot multivibrators 70-M3 and 70-M4 are applied through inverters 70-I3 and 70-I4, which may be Texas Instruments 7404 Inverters, whose outputs are applied respectively to input pins 1 and 2 of the NAND gate 70-G1 which may be a TI-7400 NAND gate, and the positive pulses at the output of the NAND gate 70-G1 are applied through inverter 70-R5, another TI-7404, through resistor 70-R5 to the gate of transistor 70-T1, whose emitter is connected to ground and whose collector is connected through resistor 70-R6 to a 28-volt regulated supply. The collector of transistor 70-T1 is also connected through resistor 70-R6 to the gate of transistor 70-T2 whose emitter is connected to the 28-volt regulated supply and whose collector is connected through 1K resistor 70-R7, connected to ground by 2K resistor 70-R8 and 10 μf capacitor 70-C1, to the gate of transistor 70-T3. The collector of transistor 70-T3 is also connected to the 28-volt regulated supply and its collector is connected through the lead 70-L to the connection point 11A of FIG. 7A providing the voltage at the top of the tension adjust potentiometer 52-R1 which determines the voltage applied to the master output lead to the electromagnet coils of the entire group of tension devices forming the associated channel.

The above described circuit permits adjustment of the false width of the positive pulses forming the pulse train 70-P5 at the output of the variable width one-shot multivibrator 70-M3 and the pulse train 70-P6 at the output of the one-shot multivibrator 70-M4, by adjustment of the ganged potentiometers 70-R1 and 70-R3, such that the pulses may be varied from very short pulses occupying only a very small portion of their respective half cycles to long pulses which occupy the full portion of their respective half cycles and slightly overlap each other in the output from the NOR gate 70-G1. The effect of this is such that the potentiometers 70-R1 and 70-R3 set the pulse width to produce trains of pulses from the two channels at the outputs of the inverters 70-I3 and 70-I4 which cause the NOR gate output to be up constantly for maximum length pulses or down most of the period for the shortest length pulses. After the tension adjusting potentiometer 52-R1 has been adjusted to provide the desired tension value, typically for example about 6 or 7 grams, for very slow warper speed or what may be termed the "stop tension," the warper is then brought up to full speed and the ganged potentiometers 70-R1 and 70-R3 are adjusted to bring the tension at fastest warper running speed, which may be termed the "running tension", down to approximately the "stop tension" value. It will be appreciated that as the warper speed, and thus the pulse generator speed increases, the pulse rate will increase, causing the pulses at the output of the variable width one-shot multivibrators 70-M3 and 70-M4 to approach nearer and nearer to an overlap pulse condition. The potentiometers 70-R1 and 70-R3 controlling these multivibrators 70-M3 and 70-M4 will have been adjusted so that they just reach or are very near to overlap pulse condition at the fastest running speed of the warper causing appropriately reduced voltage supply to potentiometer 52-R1. As the pulse rate reduces the slower warper speeds, the proportions of their respective half cycles occupied by these pulses progressively diminishes further and further from overlap condition to cause the voltage applied to the tension adjust potentiometer 52-R1 to progressively increase toward the full 28-volts. It will be appreciated that with a given pulse width setting of the ganged potentiometer 70-R1 and 70-R3, as the warper speed and pulse generator speed increases, increasing the pulse rate and reducing the period between successive positive pulses in each channel, the pulses at the output of 70-M3 and 70-M4 approach nearer and nearer to overlap, thus causing the percentage downtime of the output from inverter 70-I5 to progressively increase as speed increases. The transistors 70-T1 and 70-T2 thus have a progressively increasing nonconducting time which increases with increasing speed, and due to the DC averaging effect of the resistor 70-R7 and capacitor 70-C1 at the input to transistor 70-T3, the DC average output of transistor 70-T3 reduces with increasing speed, thus reducing the voltage applied to the top of the tension adjust potentiometer 50-R1 lower and lower from the 28-volt regulated DC available at the collector of the transistor 70-T3. The transistor 70-T1 may be a TN53, the transistor 70-T2 may be a 2N4402, and the transistor 70-T3 may be a TN53, in one practical example.

We claim:

1. Yarn tensioning apparatus for tensioning a plurality of yarns being drawn from supply packages along plural yarn paths for delivery to yarn utilization apparatus such as beamers, knitting machines and the like, comprising a plurality of electronically controlled yarn tensioning devices forming a single channel of such devices regulated by a channel control voltage on a master output lead, each tensioning device comprising an electromagnet core and coil assembly to be located along each respective yarn path and including an elongated electromagnet coil and a rigid generally rectangular loop core including a U-shaped portion formed of a longitudinal cross leg extending through the coil and transverse end legs and having a pair of pole pieces extending from said end legs toward each other defining a gap therebetween for passage of magnetic flux generated by the coil through the core legs and pole pieces, the pole pieces having a pair of flat lateral mounting faces located in a single vertical plane immediately adjacent and facing the associated yarn path, a plural plate yarn wear plate assembly supported in loosely hanging relation from the pole pieces in parallel vertical planes immediately alongside said mounting faces and spanning the gap comprising a pair of inner and outer flat yarn wear plates providing confronting substantially flat coextensive vertical yarn contacting wear surfaces between which the yarn passes in frictional contact with the faces, said outer wear plate being of magnetic material to respond to variable magnetic attractive forces of the flux passing through the pole pieces to vary the force of attraction thereon inwardly horizontally toward the pole pieces and thereby vary tension of the yarn leaving the device, and electronic control circuit means remote from the yarn tensioning devices of said channel and electrically coupled through said master output lead to each of the electromagnet coils thereof for regulating the channel control voltage applied to the coils and thereby regulating the magnetic forces exerted on the wear plates.

2. Yarn tensioning apparatus as defined in claim 1, wherein said electromagnet coil is of generally cylindrical configuration arranged along a core axis below and parallel to the yarn path adjacent the device and comprises a hollow spool member having coil windings thereon and a metallic cylindrical core member extending therethrough and arranged along a horizontal axis in normal position of use of the tension device.

3. Yarn tensioning apparatus as defined in claim 2, wherein the transverse end legs of said core comprise a pair of vertically elongated core plates arranged in parallel vertical planes transversely intersecting the yarn path and each having a hole therein for passage of the yarn therethrough, said core plates being fixed against opposite ends of the coil and abutting the ends of the pole pieces opposite said gap providing high permeability flux paths from the coil to the pole pieces.

4. Yarn tensioning apparatus as defined in claim 1, wherein the transverse end legs of said core comprise a pair of vertically elongated core plates arranged in parallel vertical planes transversely intersecting the yarn path and each having a hole therein for passage of the yarn therethrough, said core plates being fixed against opposite ends of the coil and abutting the ends of the pole pieces opposite said gap providing high permeability flux paths from the coil to the pole pieces.

5. Yarn tensioning apparatus as defined in claim 1, wherein said pole pieces are rigid metallic blocks having substantially square, co-extensive side faces forming said pair of lateral mounting faces lying in a single vertical plane facing toward the yarn path with the pole pieces spaced serially along the yarn path, and said pole pieces having a small diameter hanger pin projecting laterally substantially perpendicular to the said mounting faces of each of the pole pieces for supporting said yarn wear plate, and said inner and outer yarn wear plate each having a pair of apertures of slightly larger diameter than said hanger pins aligned therewith to support the pair of wear plates in parallel vertical planes in hanging relation from the pins, the pins being arranged along horizontal axes in use whereby the hanging wear plates are free of gravitational biasing forces toward each other or toward the pole pieces.

6. Yarn tensioning apparatus as defined in claim 4, wherein said pole pieces are rigid metallic blocks having substantially square, co-extensive side faces forming said pair of mounting faces lying in a single vertical plane facing toward the yarn path with the pole pieces spaced serially along the yarn path, and said pole pieces having a small diameter hanger pin projecting laterally substantially perpendicular to the said mounting faces of each of the pole pieces for supporting said yarn wear plates, and said inner and outer yarn wear plates each having a pair of apertures of slightly larger diameter than said hanger pins aligned therewith to support the pair of wear plates in parallel vertical planes in hanging relation from the pins, the pins being arranged along horizontal axes in use whereby the hanging wear plates are free of gravitational biasing forces toward each other or toward the pole pieces.

7. Yarn tensioning apparatus as defined in claim 1, wherein said inner yarn wear plate is of substantially non-magnetic material.

8. Yarn tensioning apparatus as defined in claim 7, wherein the surface of said outer yarn wear plate facing toward the yarn path is a ground and satin chrome finish surface.

9. Yarn tensioning apparatus as defined in claim 8, wherein the inner yarn wear plate is a non-magnetic steel plate member having its surface facing the yarn path ground and provided with hard chrome finish.

10. Yarn tensioning apparatus as defined in claim 1, wherein said electronic control circuit means includes transistor circuit means for providing said channel control voltage on said master output lead to the electromagnet coils of all of the tensioning devices of the channel, a manually adjustable tension setting potentiometer for the transistor circuit means for said channel connected to a regulated DC voltage source and having a movable contact for applying voltages to regulate the transistor circuit means in accordance with the manual setting thereof for varying the voltage level of said channel control voltage on said master output lead, and degaussing circuit means for intermittently applying negative going pulses which descend to a pre-determined negative voltage level to said master output lead during adjustment of the tension setting potentiometer in a descending voltage direction to thereby supply to the coils of said channel periodic voltage pulses descending to a negative voltage level minimizing residual magnetic effects in said core structure of the tensioning devices.

11. Yarn tensioning apparatus as defined in claim 5, wherein said electronic control circuit means includes transistor circuit means for providing said channel control voltage on said master output lead to the electromagnetic coils of all of the tensioning devices of the channel, a manually adjustable tension setting potentiometer for the transistor circuit means for said channel connected to a regulated DC voltage source and having a movable contact for applying voltages to regulate the transistor circuit means in accordance with the manual setting thereof for varying the voltage level of said channel control voltage on said master output lead, and degaussing circuit means for intermittently applying negative going pulses which descend to a predetermined negative voltage level to said master output lead during adjustment of the tension setting potentiometer in a descending voltage direction to thereby supply to the coils of said channel periodic voltage pulses descending to a negative voltage level minimizing residual magnetic effects in said core structure of the tensioning devices.

12. Yarn tensioning apparatus as defined in claim 10 wherein said degaussing circuit means includes an oscillator for producing a train of substantially rectangular negative pulses and having a potentiometer for adjusting the pulse width of said pulse, gate transistor means responsive to the pulse train output from said oscillator circuit to turn on and off the transistor circuit means providing the channel control voltage on said master output lead and means for applying to said master output lead a selected negative voltage level when said transistor circuit means are off to provide a degaussing pulse output of periodic negative going pulses of sufficient amplitude to intermittently pulse the voltage level of said channel output control voltage being supplied to the coils of the yarn tensioning devices to a negative voltage level during occurrence of each degaussing pulse regardless of the setting of said tension setting potentiometer so long as the setting thereof is being changed toward lower voltage levels.

13. Yarn tensioning apparatus as defined in claim 12 wherein said degaussing circuit includes means for automatically sensing the occurrence of reducing voltage levels on the movable contact of said tension setting potentiometer and circuit means responsive thereto for applying said intermittent negative going degaussing pulses to said master output lead upon sensing of reducing voltage levels on said movable contact.

14. Yarn tensioning apparatus as defined in claim 11 wherein said degaussing circuit means includes an oscillator for producing a train of substantially rectangular negative pulses and having a potentiometer for adjusting the pulse width of said pulses, gate transistor means responsive to the pulse train output from said oscillator circuit to turn on and off the transistor circuit means providing the channel control voltage on said master output lead and means for applying to said master output lead a selected negative voltage level when said transistor circuit means are off to provide a degaussing pulse output of periodic negative going pulses of sufficient amplitude to intermittently pulse the voltage level of said channel output control voltage being supplied to the coils of the yarn tensioning devices to a negative voltage level during occurrence of each degaussing pulse regardless of the setting of said tension setting potentiometer so long as the setting thereof is being changed toward lower voltage levels.

15. Yarn tensioning apparatus as defined in claim 14 wherein said degaussing circuit includes means for automatically sensing the occurrence of reducing voltage levels on the movable contact of said tension setting potentiometer and circuit means responsive thereto for applying said intermittent negative going degaussing pulses to said master output lead upon sensing of reducing voltage levels on said movable contact.

16. Yarn tensioning apparatus as defined in claim 1 wherein said electronic control circuit means includes a manually adjustable tension setting potentiometer for said channel and means responsive thereto for providing at variable voltage levels the said channel control voltage on said master output lead, and degaussing circuit means for intermittently applying negative going pulses which descend to a predetermined negative voltage level to said master output lead during adjustment of the tension setting potentiometer in a descending voltage direction to thereby supply to the coils of said channel periodic voltage pulses descending to a negative voltage level minimizing residual magnetic effects in said core structure of the tensioning devices.

17. Yarn tensioning apparatus as defined in claim 16 wherein said degaussing circuit includes means for automatically sensing the occurrence of reducing voltage level adjustments of said tension setting potentiometer and circuit means responsive thereto for applying said intermittent negative going degaussing pulses to said master output lead upon sensing of reducing voltage levels.

18. Yarn tensioning apparatus as defined in claim 5 wherein said electronic control circuit means includes a manually adjustable tension setting potentiometer for said channel and means responsive thereto for providing at variable voltage levels the said channel control voltage on said master output lead, and degaussing circuit means for intermittently applying negative going pulses which descend to a predetermined negative voltage level to said master output lead during adjustment of the tension setting potentiometer in a descending voltage direction to thereby supply to the coils of said channel periodic voltage pulses descending to a negative voltage level minimizing residual magnetic effects in said core structure of the tensioning devices.

19. Yarn tensioning apparatus as defined in claim 18 wherein said degaussing circuit includes means for automatically sensing the occurrence of reducing voltage level adjustments of said tension setting potentiometer and circuit means responsive thereto for applying said intermittent negative going degaussing pulses to said master output lead upon sensing of reducing voltage levels.

20. Yarn tensioning apparatus as defined in claim 6 wherein said electronic control circuit means includes a manually adjustable tension setting potentiometer for said channel and means responsive thereto for providing at variable voltage levels the said channel control voltage on said master output lead, and degaussing circuit means for intermittently applying negative going pulses which descend to a predetermined negative voltage level to said master output lead during adjustment of the tension setting potentiometer in a descending voltage direction to thereby supply to the coils of said channel periodic voltage pulses descending to a negative voltage level minimizing residual magnetic effects in said core structure of the tensioning devices.

21. Yarn tensioning apparatus as defined in claim 20 wherein said degaussing circuit includes means for automatically sensing the occurrence of reducing voltage level adjustments of said tension setting potentiometer and circuit means responsive thereto for applying said intermittent negative going degaussing pulses to said master output lead upon sensing of reducing voltage levels.

22. Yarn tensioning apparatus as defined in claims 17 or 19 or 21, wherein said degaussing circuit means includes an oscillator for producing a train of substantially rectangular negative pulses and having a potentiometer for adjusting the pulse width of said pulses, gate transistor means responsive to the pulse train output from said oscillator circuit to enable and disable the means providing the channel control voltage on said master output lead and means for applying to said master output lead a selected negative voltage level when said means providing the control voltage is disabled to provide a degaussing pulse output of periodic negative going pulses of sufficient amplitude to intermittently pulse the voltage level on said master output lead to a negative voltage level during occurrence of each degaussing pulse regardless of the setting of said tension setting potentiometer so long as the setting thereof is being changed toward lower voltage levels.

23. Yarn tensioning apparatus for tensioning yarns, comprising an electronically controlled yarn tensioning device including an electromagnet core and coil assembly to be located along a yarn path and including a rigid core structure having core faces defining a gap therebetween located in a single vertical plane immediately adjacent and facing the associated yarn path, a yarn wear surface assembly of a pair of adjacent confronting wear surface members in parallel vertical planes immediately alongside said core faces and spanning the gap providing confronting substantially flat vertical yarn contacting wear surfaces between which the yarn passes in frictical contact with such surfaces, the outer wear surface member fartherest from the core structure being of magnetic material to respond to variable magnetic attractive forces of the flux passing through the core structure to vary the force of attraction thereon inwardly horizontally toward the core structure and thereby vary tension of the yarn leaving the device and the other wear surface member of said pair being movable responsive to yarn feed movement of the yarn engaged thereby, electronic control circuit means electrically coupled to the electromagnet coil for regulating a control voltage applied to the coil and thereby regulating the magnetic forces exerted on the wear surface members, and surface displacing means for continuously moving one of said wear surface members in a predetermined path alongside the yarn path to continuously change the portion of the wear surface thereof engaging the yarn including means moving in coordinated relation to said one wear surface member to limit movement of the other wear surface member to generally corresponding movement.

24. Yarn tensioning apparatus as defined in claim 23, wherein the means moving in coordinated relation to said one wear surface member includes restraint means to limit movement of the other wear surface member to generally corresponding movement.

25. Yarn tensioning apparatus as defined in claim 23, wherein said wear surface members are first and second confronting discs supported for rotation about a common center axis.

26. Yarn tensioning apparatus as defined in claim 23, wherein said wear surface members are first and second confronting discs supported for rotation about a common center axis and wherein said surface displacing means is a motor having a rotary output coupled to the first disc to continuously rotate the same.

27. Yarn tensioning apparatus as defined in claim 23, wherein said wear surface members are first and second confronting discs supported for rotation about a shaft forming a common center axis for the discs and wherein said surface displacing means is a motor having a rotary output coupled to the first disc to continuously rotate the same, and means extending from said shaft for restraining rotation of the second disc to substantial conformity to the rotation of said first disc.

28. Yarn tensioning apparatus as defined in claim 23, wherein said wear surface members are first and second confronting discs supported for rotation about a shaft forming a common center axis for the discs and wherein said surface displacing means is a motor having a rotary output coupled to the first disc to continuously rotate the same, and means extending from said shaft for restraining rotation of the second disc to substantial conformity to the rotation of said first disc, said first disc being fixed on said shaft and said second disc being loosely journaled thereon, and spring finger means extending from said shaft to engage an abutment on the second disc and limit rotation thereof.

29. Yarn tensioning apparatus as defined in claim 23, wherein said control circuit includes a manually adjustable tension setting potentiometer and means responsive thereto for providing at variable voltage levels the said control voltage to said electromagnet core, and degaussing circuit means for intermittently applying short duration pulses which extend to a predetermined different voltage level to the electromagnet coil during adjustment of the tension setting potentiometer in a descending voltage direction to thereby supply to the coil periodic voltage pulses which cancel magnetism of the core to minimize residual magnetic effects in said core structure of the tensioning devices.

30. Yarn tensioning apparatus as defined in claim 23, wherein said control circuit includes a manually adjustable tension setting potentiometer and means responsive thereto for providing at variable voltage levels the said control voltage to said electromagnet core, and degaussing circuit means for intermittently applying negative going pulses which descend to a predetermined negative voltage level to the electromagnet coil during adjustment of the tension setting potentiometer in a descending voltage direction to thereby supply to the coil periodic voltage pulses descending to a negative voltage level to minimize residual magnetic effects in said core structure of the tensioning device.

31. Yarn tensioning apparatus as defined in claim 25, wherein said control circuit includes a manually adjustable tension setting potentiometer and means responsive thereto for providing at variable voltage levels the said control voltage to said electromagnet core, and degaussing circuit means for intermittently applying negative going pulses which descend to a predetermined negative voltage level to the electromagnet coil during adjustment of the tension setting potentiometer in a descending voltage direction to thereby supply to the coil periodic voltage pulses descending to a negative voltage level to minimize residual magnetic effects in said core structure of the tensioning device.

32. Yarn tensioning apparatus as defined in claim 27, wherein said control circuit includes a manually adjustable tension setting potentiometer and means responsive thereto for providing at variable voltage levels the said control voltage to said electromagnet core, and degaussing circuit means for intermittently applying negative going pulses which descend to a predetermined negative voltage level to the electromagnet coil during adjustment of the tension setting potentiometer in a descending voltage direction to thereby supply to the coil periodic voltage pulses descending to a negative voltage level to minimize residual magnetic effects in said core structure of the tensioning device.

33. Yarn tensioning apparatus as defined in claim 28, wherein said control circuit includes a manually adjustable tension setting potentiometer and means responsive thereto for providing at variable voltage levels the said control voltage to said electromagnet core, and degaussing circuit means for intermittently applying negative going pulses which descend to a predetermined negative voltage level to the electromagnet coil during adjustment of the tension setting potentiometer in a descending voltage direction to thereby supply to the coil periodic voltage pulses descending to a negative voltage level to minimize residual magnetic effects in said core structure of the tensioning device.

34. Yarn tensioning apparatus as defined in either of claims 29 or 30 or 31 or 32 or 33 wherein said degaussing circuit includes means for automatically sensing the occurrence of reducing voltage levels on the movable contact of said tension setting potentiometer and circuit means responsive thereto for applying said intermittent negative going degaussing pulses to the electromagnet upon sensing of reducing voltage levels on said movable contact.

35. Yarn tensioning apparatus as defined in either of claims 30 or 31 or 32 or 33, wherein said degaussing circuit means includes an oscillator for producing a train of substantially rectangular negative pulses and having a potentiometer for adjusting the pulse width of said pulses, transistor circuit means regulated by voltages applied thereto from said potentiometer for providing said control voltage to said coil, gate transistor means responsive to the pulse train output from said oscillator circuit to turn on and off the transistor circuit means providing said control voltage and means for applying to said coil a selected negative voltage level when said transistor circuit means are off to provide a degaussing pulse output of periodic negative going pulses of sufficient amplitude to intermittently pulse the voltage level of said control voltage being supplied to the coil to a negative voltage level during occurrence of each degaussing pulse regardless of the setting of said tension setting potentiometer so long as the setting thereof is being changed toward lower voltage levels.

36. Yarn tensioning apparatus for tensioning yarns, comprising an electronically controlled yarn tensioning device including an electromagnet core and coil assembly to be located along a yarn path and including a rigid core structure having core faces defining a gap therebetween located in a single vertical plane immediately adjacent and facing the associated yarn path, a yarn wear surface assembly of a pair of adjacent confronting wear surface members in parallel vertical planes immediately alongside said core faces and spanning the gap providing confronting substantially flat vertical yarn contacting wear surfaces between which the yarn passes in frictional contact with such surfaces, the outer wear surface member fartherest from the core structure being of magnetic material to respond to variable magnetic attractive forces of the flux passing through the core structure to vary the force of attraction thereon inwardly horizontally toward the core structure and thereby vary tension of the yarn leaving the device, electronic control circuit means electrically coupled to the electromagnet coil for regulating a control voltage applied to the coil and thereby regulating the magnetic forces exerted on the wear surface members, including a manually adjustable tension setting potentiometer and means responsive thereto for providing at variable voltage levels the said control voltage to said coil, and degaussing circuit means for intermittently applying negative going pulses which descend to a predetermined negative voltage level to said coil during adjustment of the tension setting potentiometer in a descending voltage direction to thereby supply to the coil periodic voltage pulses descending to a negative voltage level minimizing residual magnetic effects in said core structure of the tensioning device.

37. Yarn tensioning apparatus as defined in claim 36, wherein said degaussing circuit includes means for automatically sensing the occurrence of reducing voltage levels on the movable contact of said tension setting potentiometer and circuit means responsive thereto for applying said intermittent negative going degaussing pulses to said coil upon sensing of reducing voltage levels on said movable contact.

38. Yarn tensioning apparatus as defined in claim 36, wherein said degaussing circuit means includes an oscillator for producing a train of substantially rectangular negative pulses and having a potentiometer for adjusting the pulse width of said pulses, transistor circuit means regulated by voltages applied thereto from said potentiometer for providing said control voltage to said coil, gate transistor means responsive to the pulse train output from said oscillator circuit to turn on and off the transistor circuit means providing said control voltage and means for applying to said coil a selected negative voltage level when said transistor circuit means are off to provide a degaussing pulse output of periodic negative going pulses of sufficient amplitude to intermittently pulse the voltage level of said control voltage being supplied to the coil to a negative voltage level during occurrence of each degaussing pulse regardless of the setting of said tension setting potentiometer so long as the setting thereof is being changed toward lower voltage levels.

39. Yarn tensioning apparatus for tensioning a plurality of yarns being drawn from supply packages along plural yarn paths for delivery to yarn utilization apparatus such as beamers, knitting machines and the like, comprising a plurality of electronically controlled yarn tensioning devices forming a single channel of such devices regulated by a channel control voltage on a master output lead, each tensioning device comprising an electromagnet core and coil assembly to be located along each respective yarn path and including a rigid core structure defining a gap and having a pair of flat lateral mounting faces located in a single vertical plane immediately adjacent and facing the associated yarn path, a yarn wear surface assembly of a pair of adjacent confronting wear surface members formed of first and second confronting discs supported for rotation about a shaft forming a common center axis for the discs in parallel vertical planes immediately alongside said mounting faces and spanning the gap providing confronting substantially flat vertical yarn contacting wear surfaces between which the yarn passes in frictional contact with such surfaces, the outer wear surface member fartherest from the core structure being of magnetic material to respond to variable magnetic attractive forces of the flux passing through the core structure to vary the force of attraction thereon inwardly horizontally toward the core structure and thereby vary tension of the yarn leaving the device, electronic control circuit means remote from the yarn tensioning devices of said channel and electrically coupled through said master output lead to each of the electromagnet coils thereof for regulating the channel control voltage applied to the coils and thereby regulating the magnetic forces exerted on the wear surface members, and surface displacing means including a motor having a rotary output coupled to the first disc to continuously rotate the same in a predetermined path alongside the yarn path to continuously change the portion of the wear surface thereof engaging the yarn and means extending from said shaft for restraining rotation of the second disc to substantial conformity to the rotation of said first disc.

40. Yarn tensioning apparatus as defined in claim 39, wherein said wear surface members are first and second confronting discs supported for rotation about a shaft forming a common center axis for the discs and wherein said surface displacing means is a motor having a rotary output coupled to the first disc to continuously rotate the same, and means extending from said shaft for restraining rotation of the second disc to substantial conformity to the rotation of said first disc, said first disc being fixed on said shaft and said second disc being loosely journaled thereon, and spring finger means extending from said shaft to engage an abutment on the second disc and limit rotation thereof.

41. Yarn tensioning apparatus as defined in claim 39, wherein said control circuit includes a manually adjustable tension setting potentiometer and means responsive thereto for providing at variable voltage levels the said control voltage to said electromagnet core, and degaussing circuit means for intermittently applying negative going pulses which descend to a predetermined negative voltage level to the electromagnet coil during adjustment of the tension setting potentiometer in a descending voltage direction to thereby supply to the coil periodic voltage pulses descending to a negative voltage level to minimize residual magnetic effects in said core structure of the tensioning device.

42. Yarn tensioning apparatus as defined in claim 40, wherein said control circuit includes a manually adjustable tension setting potentiometer and means responsive thereto for providing at variable voltage levels the said control voltage to said electromagnet core, and degaussing circuit means for intermittently applying negative going pulses which descend to a predetermined negative voltage level to the electromagnet coil during adjustment of the tension setting potentiometer in a descending voltage direction to thereby supply to the coil periodic voltage pulses descending to a negative voltage level to minimize residual magnetic effects in said core structure of the tensioning device.

43. Yarn tensioning apparatus as defined in claim 23, including yarn speed responsive tension equalizer means comprising pulse generator means for producing trains of pulses at pulse rates related to the speed of yarn feed to the utilization apparatus, and means responsive to the pulse rate of said pulses to automatically vary the control voltage applied by said control circuit means to said coil in inverse relation to variations in the yarn feed speed to minimize variation in tensioning of the yarn by the tensioning device with changes in the yarn feed speed.

44. Yarn tensioning apparatus as defined in claim 25, including yarn speed responsive tension equalizer means comprising pulse generator means for producing trains of pulses at pulse rates related to the speed of yarn feed to the utilization apparatus, and means responsive to the pulse rate of said pulses to automatically vary the voltage applied by said control circuit means to said coil in inverse relation to variations in the yarn feed speed to minimize variation in tensioning of the yarn by the tensioning device with changes in the yarn feed speed.

45. Yarn tensioning apparatus as defined in claim 29, including yarn speed responsive tension equalizer means comprising pulse generator means for producing trains of pulses at pulse rates related to the speed of yarn feed to the utilization apparatus, and means responsive to the pulse rate of said pulses to automatically vary the voltage supplied to said potentiometer in inverse relation to variations in the yarn feed to minimize variation in tensioning of the yarn by the tensioning device with changes in the yarn feed speed.

46. Yarn tensioning apparatus as defined in claim 31, including yarn speed responsive tension equalizer means comprising pulse generator means for producing trains of pulses at pulse rates related to the speed of yarn feed to the utilization apparatus, and means responsive to the pulse rate of said pulses to automatically vary the voltage supplied to said potentiometer in inverse relation to variations in the yarn feed speed to minimize variation in tensioning of the yarn by the tensioning device with changes in the yarn feed speed.

47. Yarn tensioning apparatus as defined in claim 32, including yarn speed responsive tension equalizer means comprising pulse generator means for producing trains of pulses at pulse rates related to the speed of yarn feed to the utilization apparatus, and means responsive to the pulse rate of said pulses to automatically vary the voltage supplied to said potentiometer in inverse relation to variations in the yarn feed speed to minimize variation in tensioning of the yarn by the tensioning device with changes in the yarn feed speed.

48. Yarn tensioning apparatus as defined in claim 36, including yarn speed responsive tension equalizer means comprising pulse generator means for producing trains of pulses at pulse rates related to the speed of yarn feed to the utilization apparatus, and means responsive to the pulse rate of said pulses to automatically vary the voltage applied by said circuit means to said potentiometer in inverse relation to variations in the yarn feed speed to minimize variation in tensioning of the yarn by the tensioning device with changes in the yarn feed speed.

49. Yarn tensioning apparatus as defined in claim 39, including yarn speed responsive tension equalizer means comprising pulse generator means for producing trains of pulses at pulse rates related to the speed of yarn feed to the utilization apparatus, and means responsive to the pulse rate of said pulses to automatically vary the control voltage applied by said control circuit means to said coils in inverse relation to variations in the yarn feed speed to minimize variations in tensioning of the yarn by the tensioning devices with changes in the yarn feed speed.

50. Yarn tensioning apparatus as defined in claim 43, wherein said control circuit means includes an adjustable potentiometer supplied with a predetermined supply voltage level for regulating the level of said control voltage to apply a chosen tension on the yarn for a selected yarn feed state, and said equalizer means includes means responsive to the amount of increase of yarn feed speed above said state to reduce said supply voltage level by amounts appropriate to minimize variation from said chosen tension upon changes in yarn feed speed.

51. Yarn tensioning apparatus as defined in claim 44, wherein said control circuit means includes an adjustable potentiometer supplied with a predetermined supply voltage level for regulating the level of said control voltage to apply a chosen tension on the yarn for a selected yarn feed state, and said equalizer means includes means responsive to the amount of increase of yarn feed speed above said state to reduce said supply voltage level by amounts appropriate to minimize variation from said chosen tension upon changes in yarn feed speed.

* * * * *